US007783223B2

(12) United States Patent
Takahashi et al.

(10) Patent No.: US 7,783,223 B2
(45) Date of Patent: Aug. 24, 2010

(54) IMAGE FORMING APPARATUS WITH PLURALITY OF AC POWER CORDS

(75) Inventors: Atsushi Takahashi, Akishima (JP); Utami Soma, Hachioji (JP); Youbao Peng, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 757 days.

(21) Appl. No.: 11/506,015

(22) Filed: Aug. 17, 2006

(65) Prior Publication Data

US 2007/0116487 A1 May 24, 2007

(30) Foreign Application Priority Data

Nov. 24, 2005 (JP) ..... 2005-339179

(51) Int. Cl.
*G03G 15/00* (2006.01)

(52) U.S. Cl. ..... 399/88; 399/90

(58) Field of Classification Search ..... 399/88, 399/90

See application file for complete search history.

(56) References Cited

U.S. PATENT DOCUMENTS 5,589,718 A * 12/1996 Lee ..... 307/72
6,486,407 B1 * 11/2002 Hawker et al. ..... 174/149 B
2004/0177283 A1 * 9/2004 Madany et al. ..... 713/300

FOREIGN PATENT DOCUMENTS

| | | | |
|---|---|---|---|
| JP | 62153771 A | * | 7/1987 |
| JP | 2003-244359 | | 8/2003 |
| JP | 2003-295702 | | 10/2003 |
| JP | 2003-323085 | | 11/2003 |
| JP | 2005-121681 | | 5/2005 |

OTHER PUBLICATIONS

Abstract of JP 62153771 A. Maruyama.*
English translation of JP 2003244359.*

* cited by examiner

*Primary Examiner*—David M Gray
*Assistant Examiner*—Ryan D Walsh
(74) *Attorney, Agent, or Firm*—Cantor Colburn LLP

(57) ABSTRACT

There is described an image forming apparatus, in which a plurality of AC power cords are combined with each other, so as to stably supply the electric power to the loading sections from the combined points, regardless of the fluctuation of the electric power consumption in the loading sections coupled to the combined points. The image forming apparatus includes: a plurality of AC power cords that are respectively coupled to a plurality of AC power supplying sources, which are substantially equivalent to relative to each other in phase and amplitude of AC voltages of the plurality of AC power supplying sources; and a combining section to combine AC electric power units supplied through the plurality of AC power cords into a combined electric power, so as to supply the combined electric power to a load.

12 Claims, 5 Drawing Sheets

CAPITAL ALPHABET INDICATES POSITION OF WAVEFORM SHOWN IN FIG. 6

COMMENT 1: VERTICAL AXIS REPRESENTS VOLTAGE, WHILE HORIZONTAL AXIS REPRESENTS TIME IN EVERY COORDINATE SHOWN IN THE ABOVE
COMMENT 2: 100V AND 10V INDICATED ON VERTICAL AXIS ARE NOMINAL VALUE

PRIOR ART

IMAGE FORMING APPARATUS WITH PLURALITY OF AC POWER CORDS

This application is based on Japanese Patent Application No. 2005-339179 filed on Nov. 24, 2005 in Japanese Patent Office, the entire content of which is hereby incorporated by reference.

BACKGROUND OF THE INVENTION

The present invention relates to a single functional apparatus, such as a printer, a copier and a facsimile, and a compound image forming apparatus having the abovementioned functions, and specifically relates to a technology for stably supplying an electric power to the image forming apparatus, which consumes a large amount of electric power, corresponding to variations of loading needs (electric power consumption).

Generally speaking, as shown in FIG. 8, in a conventional image forming apparatus, an AC electric power source 1 is coupled to an electric power inlet of the image forming apparatus through an AC cord 3 so as to supply the AC electric power of 100 V into a transformer 13. The transformer 13 transforms the inputted voltage to supply the electric power to a load 8. The load 8 of the image forming apparatus includes a fixing section 8*a* having a heater driven by the AC electric power for conducting the heat fixing operation, a control/processing section 8*b* driven by a DC electric power and including a control section provided with a CPU (Central Processing Unit), a storage, etc. for controlling various kinds of sections, and other processing sections. A heater driving section 6 receives the AC electric power fed from a secondary winding of the transformer 13 so as to supply a predetermined AC electric power to the fixing section 8*a* to control it. An AC-to-DC converting section 7 also receives the AC electric power fed from a secondary winding of the transformer 13, and rectifies the AC electric power in a rectifying section 7*a*, and converts the voltage of the rectified DC electric power to a predetermined DC voltage in order to supply it into the control/processing section 8*b*.

Generally speaking, the allowable value of electric power to be fed through a single AC electric power cord is set at 100V-15 A in Japan. However, the recent image forming apparatus tends to inevitably consume electric power larger than the above. Accordingly, there have been proposed various kinds of countermeasures to cope with the problem mentioned in the above, so far.

For instance, Patent documents 1 and 2 (Tokkai 2003-244359 and Tokkai 2003-295702, Japanese Non-Examined Patent Publications) set forth a method for allotting a plurality of AC electric power cords to a plurality of divided loads, respectively. According to the abovementioned method, an AC electric cord is allotted to the fixing section 8*a*, while another AC electric cord is allotted to the control/processing section 8*b*. Further, to solve the safety problem of the apparatus when the AC electric cord is coupled to the electric power source, while the other AC electric cord is not coupled to the electric power source, a relay provided for turning ON/OFF the connection between the AC electric cord and the electric power source is controlled so as to secure the safety of the apparatus.

Further, Patent Document 3 (Tokkai 2003-323085, Japanese Non-Examined Patent Publication) sets forth a method in which a plurality of AC electric power cords are provided as described in the Patent Document 1, and the load is divided into a plurality of blocks which are coupled to the plurality of AC electric power cords through the switches, so that the electric power is supplied to each of the plurality of blocks from any one of the plurality of AC electric power cords. Then, by changing over the switches corresponding to each of the operating modes, electric power consumptions of which are different from each other, such as a start-up mode and a deactivating mode of the fixing apparatus, etc., the load to be coupled to the AC electric power cord is changed over corresponding to the electric power consumption.

Further, in the technology set forth in Patent Document 4 (Tokkai 2005-121681, Japanese Non-Examined Patent Publication), as described in Patent Document 1, an individual AC electric power cord is allotted to each of a plurality of loads. Further, the image forming apparatus is provided with a defect detecting mechanism for detecting an abnormality of the electric power controlling element for controlling the electric power supply, and/or a mechanism for detecting an abnormality of the electric power controlling element of the heater of the fixing device, in order to secure the safety of the apparatus.

According to the abovementioned conventional technologies in which each of the AC electric power cords are adaptively coupled, corresponding to each of the loads equipped in the image forming apparatus serving as an electro-mechanical apparatus whose electric power consumption widely varies with its operating mode, it is impossible to conduct such the electric power adjustment, corresponding to the electric power variations, that the electric power is supplied from a first AC electric power cord instead of a second electric power cord, even if the electric power consumption of the load coupled to the second electric power cord is large, while the electric power consumption of the load coupled to the first electric power cord is small. To solve the above problem, in the technology set forth in the Patent Document 3, the electric power adjustment is conducted by changing over the relationships between the plurality of AC electric power cords and the plurality of loading blocks corresponding to each of the operating modes.

In the technology set forth in the Patent Document 3, however, only the electric power adjustment corresponding to the operating modes established in advance can be conducted as mentioned in the above. In addition, in this case, it is necessary to investigate even instantaneous electric power consumption at the start-up time of the operation, by probing the operating modes and the loading blocks in advance, and the change-over operation of the AC electric power cord conducted during the activated state of the image forming apparatus has been liable to induce various problems.

SUMMARY OF THE INVENTION

To overcome the abovementioned drawbacks in conventional image forming apparatus, it is an object of the present invention to provide an image forming apparatus, in which a plurality of AC power cords are combined with each other, so as to stably supply the electric power to the loading sections from the combined points, regardless of the fluctuation of the electric power consumption in the loading sections coupled to the combined points.

Accordingly, to overcome the cited shortcomings, the abovementioned object of the present invention can be attained by image forming apparatus described as follow.

(1) An image forming apparatus, comprising: a plurality of AC power cords that are respectively coupled to a plurality of AC power supplying sources, which are substantially equivalent to relative to each other in phase and amplitude of AC voltages of the plurality of AC power supplying sources; and a combining section to combine AC electric power units supplied through the plurality of AC power cords into a combined electric power, so as to supply the combined electric power to a load.

(2) An image forming apparatus, comprising: a plurality of AC power cords that are respectively coupled to a plurality of AC power supplying sources; a phase difference detecting section to detect a phase difference between AC voltages on any two of the plurality of AC power cords; a phase converting section to change over a phase of any one of the AC voltages so as to make phases of the AC voltages substantially equal to each other, based on the phase difference detected by the phase difference detecting section; and a combining section to combine AC electric power units, which are supplied through the plurality of AC power cords and phases of which are made to be substantially equal to each other by employing the phase difference detecting section and the phase converting section, into a combined electric power, so as to supply the combined electric power to a load.

(3) An image forming apparatus, comprising: a plurality of AC power cords that are respectively coupled to a plurality of AC power supplying sources; a phase difference detecting section to detect a phase difference between AC voltages on any two of the plurality of AC power cords; a plurality of current detecting sections to detect electric currents flowing through the plurality of AC power cords, respectively; a phase converting section to change over a phase of any one of the AC voltages so as to make phases of the AC voltages substantially equal to each other, based on the phase difference detected by the phase difference detecting section; a combining section to combine AC electric power units, which are supplied through the plurality of AC power cords and phases of which are made to be substantially equal to each other by employing the phase difference detecting section and the phase converting section, into a combined electric power; and a current limiting section to limit an electric current flowing through a specific one of the plurality of AC power cords to a value equal to or lower than a predetermined current value, when the electric current, flowing through the specific one of the plurality of AC power cords and detected by any one of the plurality of current detecting sections, exceeds the predetermined current value; wherein the combined electric power is supplied to a load through the combining section.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
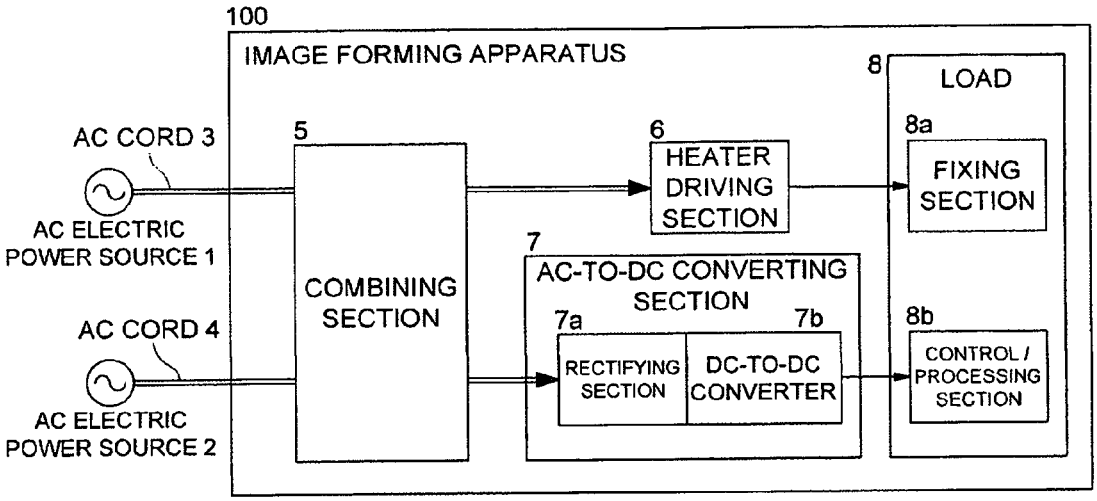
FIG. 1 shows a functional block diagram of an image forming apparatus as the first embodiment of the present invention.
Figure 2:
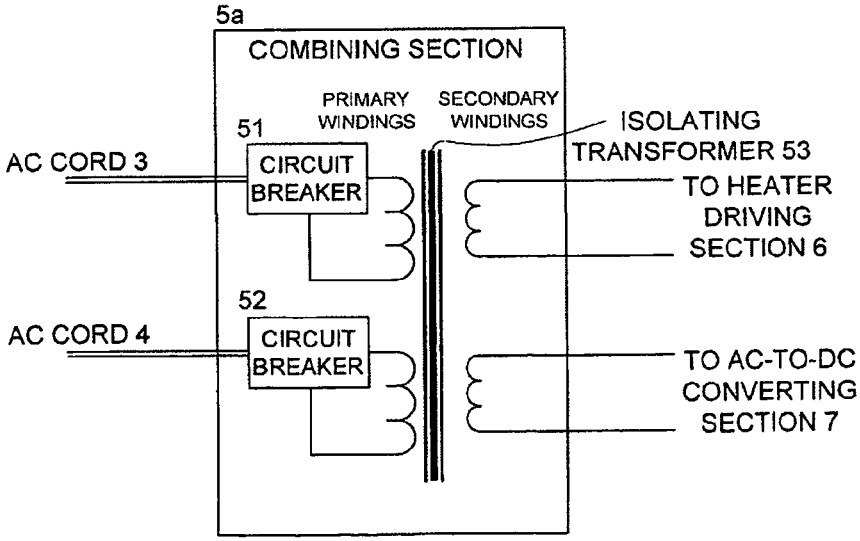
FIG. 2 shows an explanatory drawing for explaining an example of a combining section shown in FIG. 1.
Figure 3:
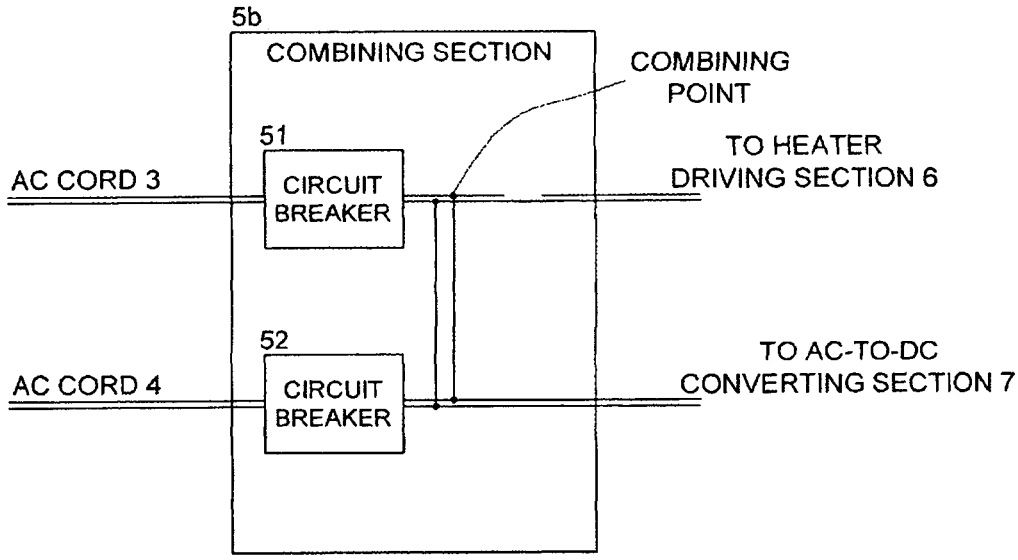
FIG. 3 shows an explanatory drawing for explaining another example of the combining section shown in FIG. 1.
Figure 4:
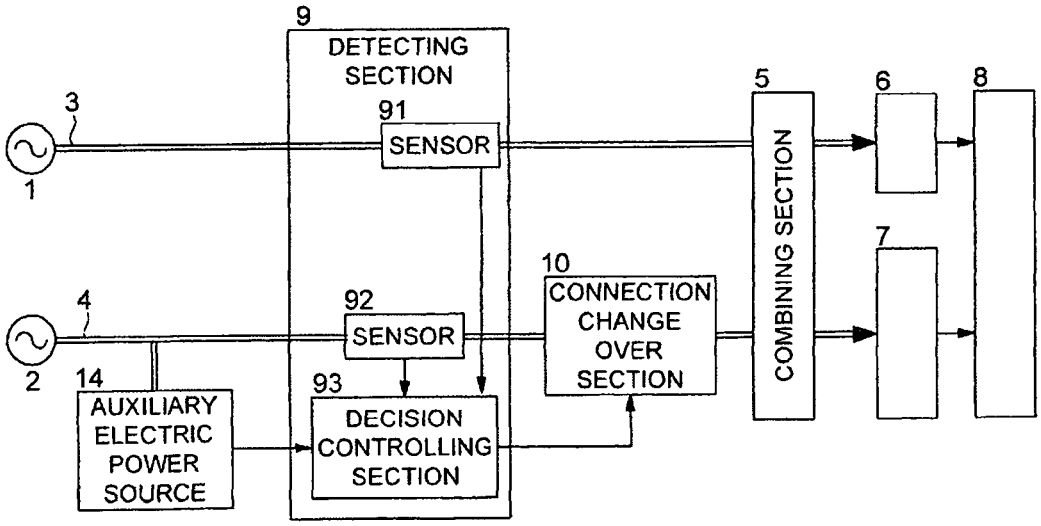
FIG. 4 shows a functional block diagram of an image forming apparatus as the second embodiment of the present invention.
Figure 5:
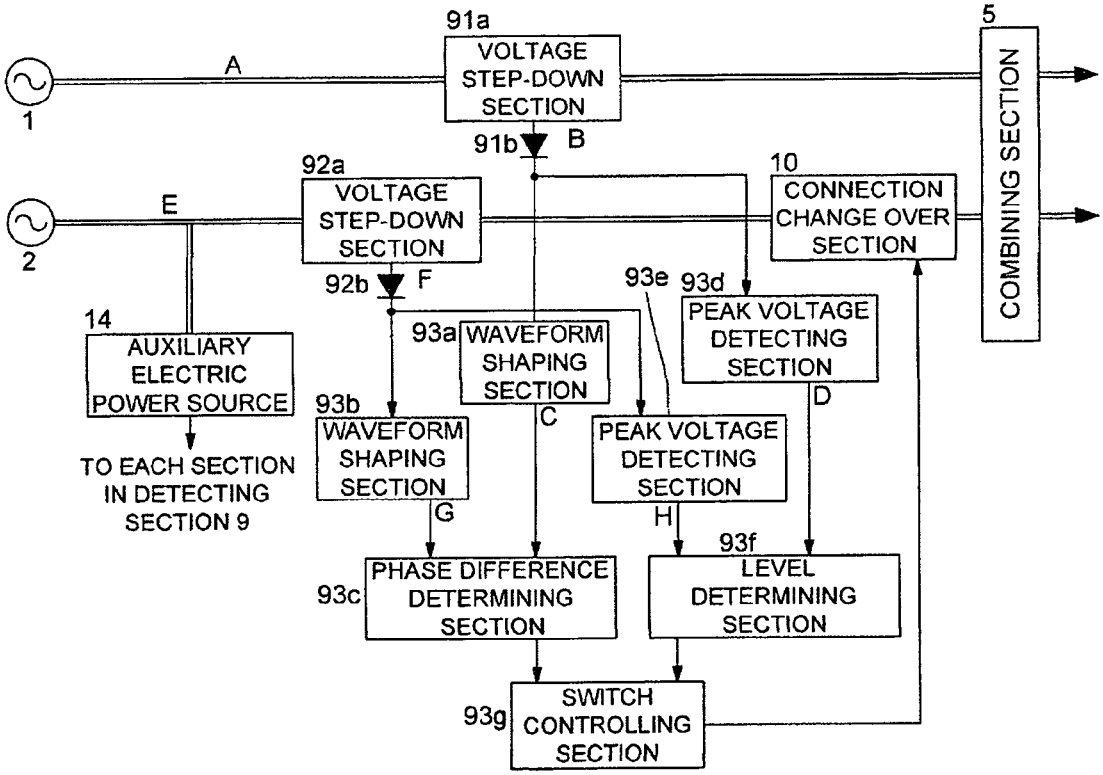
FIG. 5 shows a functional block diagram of a part of an image forming apparatus as the third embodiment of the present invention.
Figure 6:
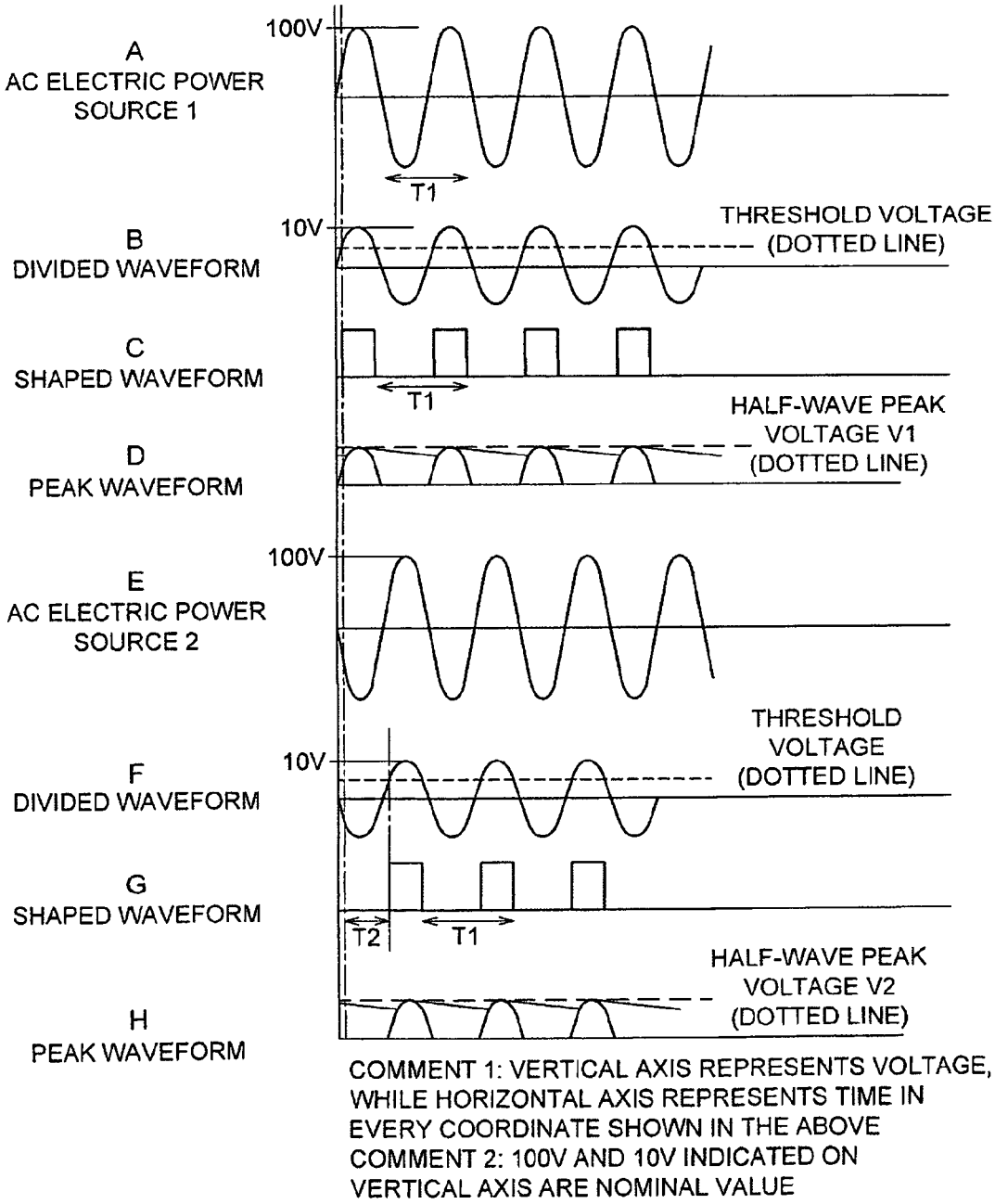
FIG. 6 shows a timing chart of the operations performed in both the second and the third embodiments.
Figure 7:
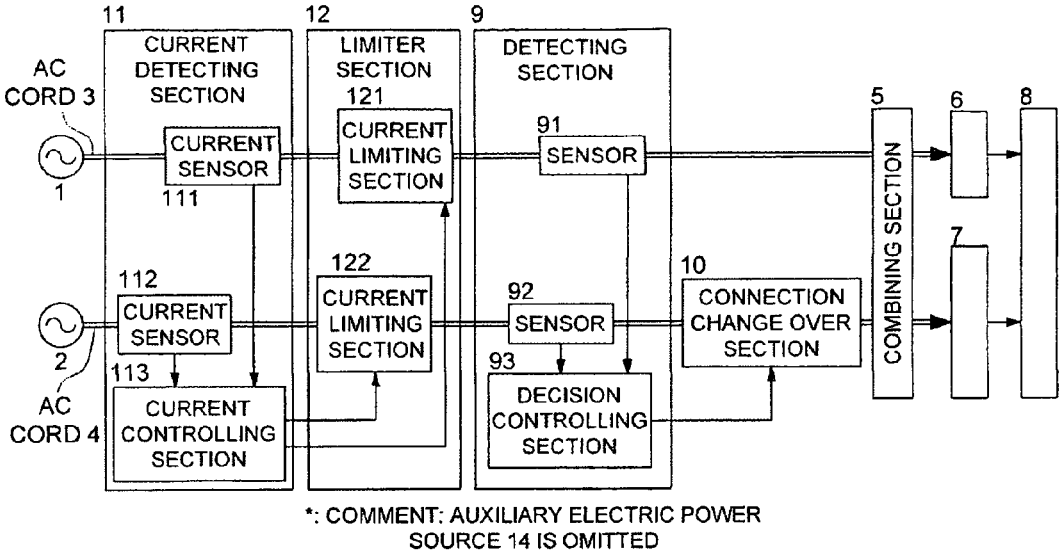
FIG. 7 shows a functional block diagram of a part of an image forming apparatus as the fourth embodiment of the present invention.

Referring to FIG. 1 through FIG. 7, the preferred embodiment will be detailed in the following. FIG. 1 shows a functional block diagram of an image forming apparatus as the first embodiment of the present invention. FIG. 2 shows an explanatory drawing for explaining an example of a combining section 5 shown in FIG. 1 (also shown in FIG. 4, FIG. 5 and FIG. 7). FIG. 3 shows an explanatory drawing for explaining another example of a combining section 5 shown in FIG. 1 (also shown in FIG. 4, FIG. 5 and FIG. 7). FIG. 4 shows a functional block diagram of an image forming apparatus as the second embodiment of the present invention. FIG. 5 shows a functional block diagram of a part of an image forming apparatus as the third embodiment of the present invention, and also indicates a detailed configuration of the combining section 5 shown in FIG. 2. FIG. 6 shows a timing chart of the operations performed in both the second and the third embodiments. FIG. 7 shows a functional block diagram of a part of an image forming apparatus as the fourth embodiment of the present invention.

The first embodiment indicates an example in which a phase and a voltage of the AC electric power fed from an AC electric power source 1 respectively coincide with those fed from an AC electric power source 2. The second embodiment indicates an example in which, even when the phases of AC voltages of the AC electric powers fed from a plurality of electric power sources are different from each other (although the AC electric current can be handled in the same manner as far as a phase is concerned as an object of consideration, hereinafter, the phase of AC voltage will be employed in the following explanations), those are made to be a same phase. The third embodiment indicates an example in which amplitude of the AC voltage is further confirmed in addition to the second embodiment. The third embodiment indicates an example in which the AC electric current is limited when an overload occurs. The abovementioned embodiments will be detailed in order of the above in the following.

First Embodiment

Figure 8:
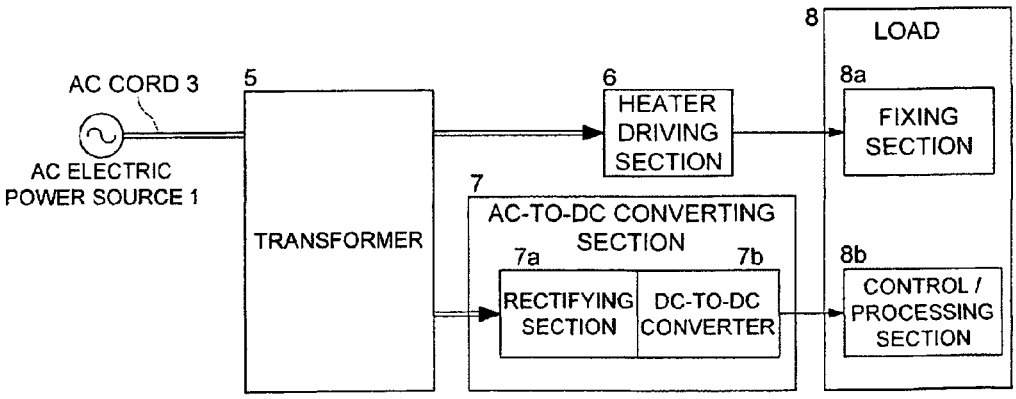
FIG. 8 shows a functional block diagram of a part of an image forming apparatus for explaining a prior art.

Referring to FIG. 1, the first embodiment will be detailed in the following. In FIG. 1, explanations for the functional elements attached with the same reference numbers as those shown in the FIG. 8 will be omitted, since the functions of both of them are also the same. In FIG. 1, the AC electric power source 1 and the AC electric power source 2 can supply the AC electric powers having the same phase and the same voltage (current), respectively. The commercial power sources provided in the room, the uninterruptible power equipments, etc. are available as the AC electric power source 1 and the AC electric power source 2. It is applicable that both are either the same or different from each other.

As mentioned in the above, since the phase and the amplitude of the AC voltage fed from the AC electric power source 1 through an AC cord 3 coincide with those of the AC voltage fed from the AC electric power source 2 through an AC cord 4, it is possible to combine them either indirectly or directly in the combining section 5. An example of the former is indicated in FIG. 2, while an example of the latter is indicated in FIG. 3.

FIG. 2 shows an indirect coupling with an isolating transformer 53. As shown in FIG. 2, the AC cord 3 and the AC cord 4 are coupled to separate primary windings of the isolating transformer 53, having the same winding number, through a circuit breaker 51 and a circuit breaker 52, respectively, so as to combine the electric powers fed through them. Then, the combined AC electric power branches into two secondary windings from which the transformed AC voltages are supplied to a heater driving section 6 and an AC-DC converting section 7, respectively.

FIG. 3 shows a direct coupling with wire connections. The AC cord 3 is coupled to the input of the circuit breaker 51, while the AC cord 4 is coupled to the input of the circuit breaker 52. Then, the output of the circuit breaker 51 is directly coupled to the output of the circuit breaker 52 with the wire connections. The combined AC electric power branches into the heater driving section 6 and the AC-DC converting section 7 from the connecting points, respectively.

The functions and operations of the circuit breaker 51 and the circuit breaker 52 are the same, and each of them is provided with a thermal fuse, etc. for securing the safety from excessive current flow caused by a short, etc. Since these are elements for general use, the explanations for them are omitted.

The fixing section 8*a* is provided with a heater. Sometimes, an induction heating heater is employed for this purpose. The heater driving section 6 drives and controls the heater of the fixing section 8*a*. For instance, the triac to be employed for the pulse width controlling operation can be cited as the semiconductor element for controlling the temperature of the heater. Further, sometimes, the high-frequency DC power source used for driving the induction heating heater is provided.

According to the abovementioned configuration, it becomes possible to supply the AC electric power within a capacity of two AC electric power cords, even if the AC supply current fluctuates due to the fluctuations of the loads.

Second Embodiment

Referring to FIG. 4, the second embodiment will be detailed in the following. In FIG. 4, explanations for the functional elements attached with the same reference numbers as those shown in the FIG. 1 will be omitted, since the functions of both of them are also the same. However, in the second embodiment, although the amplitudes of the voltages of the AC electric power source 1 and the AC electric power source 2 are substantially the same relative to each other, the phases of them are possibly different from each other. For instance, since the AC electric power is fed from the commercial electric power source through a pair of hot and neutral lines, sometimes depending on the connecting (inserting) manner of the plug socket, the phase of the AC voltage fed by the AC cord 3 is reversed, compared to that fed by the AC cord 4, due to the misalignment of the hot and neutral lines between the AC cord 3 and the AC cord 4. According to the configuration of the present invention, it is possible to cope with such the case as mentioned in the above. As well as the configuration shown in FIG. 1, the commercial power sources provided in the room, the uninterruptible power equipments, etc. are available as the AC electric power source 1 and the AC electric power source 2.

A connection change over section 10, shown in FIG. 4 and serving as a phase converting section, replaces two lines of the AC cord 4 with each other, namely, changes the hot line and the neutral line relative to each other, so as to align the phase of the AC voltage on the AC cord 4 with that on the AC cord 3. Incidentally, it is needless to say that the connection change over section 10 can be equipped on the AC cord 3, instead of the AC cord 4. The connection change over section 10 is provided with a relay, etc. for achieving the abovementioned change over operation. A detecting section 9 is constituted by a sensor 91, a sensor 92 and a decision controlling section 93. The sensor 91 acquires a first step-down AC voltage (or AC current) from the AC cord 3, while the sensor 92 acquires a second step-down AC voltage (or AC current) from the AC cord 4. The step-down ratios of the first and second step-down AC voltages are set at a same value, for instance, set at 1/10. The decision controlling section 93 compares the phase of the first step-down AC voltage with that of the second step-down AC voltage. Then, as a result of the abovementioned comparison, when the phases of the first and second step-down AC voltages coincide with each other, the decision controlling section 93 does not output a change over instruction to the connection change over section 10 so as to keep the phase as it is, while when phases of the first and second step-down AC voltages are different from each other by substantially 180 degrees, the decision controlling section 93 output the change over instruction to the connection change over section 10, so as to change the hot line and the neutral line relative to each other, to make the phase of the AC voltage on the AC cord 4 same as that on the AC cord 3, and then, maintains the same phase state of them.

An auxiliary electric power source 14 is used for supplying the electric power to the decision controlling section 93, and provided with a simple AC-DC converter. Hereinafter, the configurations shown in FIG. 5 and FIG. 7 are also provided with the auxiliary electric power source 14.

Although the effect of the second embodiment is the same as that of the first embodiment, the second embodiment is characterized in that it is possible to cope with such the case that the phases of the AC electric power source 1 and the AC electric power source 2 are different from each other. The detailed operations in the second embodiment will be also detailed in the following explanations of the third embodiment.

Third Embodiment

Referring to FIG. 5 and FIG. 6, the third embodiment will be detailed in the following. In FIG. 5, explanations for the functional elements attached with the same reference numbers as those shown in the FIG. 1 and FIG. 2 will be omitted, since the functions of both of them are also the same. However, in the third embodiment, as well as in the second embodiment, the phases of the voltages of the AC electric power source 1 and the AC electric power source 2 are possibly different from each other. FIG. 5 shows details of the detecting section 9 shown in FIG. 4. Further, according to the configuration shown in FIG. 5, it becomes possible not only to cope with the difference between the AC voltages fed from the AC electric power source 1 and the AC electric power source 2, but also to confirm the amplitudes of them.

A pair of a voltage step-down section 91*a* and a diode 91*b*, and another pair of a voltage step-down section 92*a* and a diode 92*b*, shown in FIG. 5, constitutes the sensor 91 and the sensor 92, shown in FIG. 4, respectively. The voltage step-down section 91*a* and the voltage step-down section 92*a*, have the same configuration in which, for instance, 100V (half wave value) on the AC cord 4 is divided into 10V (half wave value) by resistors having high resistivity, to output the divided voltage of 10V (refer to the waveforms A, B, E and F shown in FIG. 6). The diode 91*b* and the diode 92*b* rectifies the divided voltages outputted from the voltage step-down section 91*a* and the voltage step-down section 92*a*, to output only the positive waveforms (refer to the waveforms D and H shown in FIG. 6), respectively.

In FIG. 5, the elementary blocks attached with the reference numbers including 93 constitute the decision controlling section 93 shown in FIG. 4. Configurations of a waveform shaping section 93*a* and a waveform shaping section 93*b* are the same as each other, and each of them compares a waveform, outputted form any one of the voltage step-down section 91*a* and the diode 92*b* or any one of diode 91*b* and diode 92*b*, with a threshold voltage so as to convert it to the rectangular wave. As shown in FIG. 6, each of the waveforms outputted from the voltage step-down section 91*a* and the voltage step-down section 92*a* is compared with the threshold voltage B or F shown in FIG. 6, so as to shape it into the waveform C or G shown in FIG. 6. Incidentally, the threshold voltages B and F shown in FIG. 6 are set at the same value.

In FIG. 6, the waveform A outputted from the AC electric power source 1 and the waveform E outputted from the AC electric power source 2 represent the case in which the periods of both the waveforms are the same, but the phases of them are different from each other. Accordingly, the waveforms C and G shown in FIG. 6, which are shaped by comparing with the same threshold voltage, also have the same period (T1), but the phases different from each other. The phase difference between the waveform A and the waveform E is represented by a phase difference T2.

A phase difference determining section 93*c* compares the rectangular waveforms, outputted from the waveform shaping section 93*a* and the waveform shaping section 93*b*, with each other to detect the phase difference T2.

At this time, to describe a switch controlling section 93*g*, it is assumed in the following that a level determining section 93*f* does not exist (the case in which the level determining section 93*f* exists will be detailed later). When the phase difference determining section 93*c* determines that the phase difference T2 is zero, the switch controlling section 93*g* sends an instruction for maintaining the current state as it is to the connection change over section 10, while, when the phase difference determining section 93*c* determines that the phase difference T2 is substantially 180 degree (½ of the period T1), the switch controlling section 93*g* sends an instruction for changing the hot line and the neutral line relative to each other and maintaining the change over state as it is to the connection change over section 10. Specifically, the term of "substantially" in the above description of "substantially 180 degree" means that, although a phase difference component, for instance, caused by the difference between the lengths of AC cords would be included in the phase difference T2 if the phase difference were detected in a highly precision manner, such the subtle difference could be ignored for this purpose and it is sufficient to detect whether or not the phases are shifted from each other at about 180 degree. In other words, the phase difference determining section 93*c* detects whether or not the phases of the waveform A outputted from the AC electric power source 1 and the waveform E outputted from the AC electric power source 2 are reversed relative to each other, and when determining that the phases are reversed relative to each other, the switch controlling section 93*g* sends the change over instruction to the connection change over section 10.

The explanation described so far in regard to the configuration shown in FIG. 5 is equivalent to the detailed explanation of the configuration shown in FIG. 4. Next, a method for confirming amplitude of the AC voltage will be detailed in the following. In this case, the level determining section 93*f* makes a decision for the amplitude so as to effectively utilize the determined result.

The configurations of a peak voltage detecting section 93*d* and a peak voltage detecting section 93*e* are the same as each other, and each of them detects a half-wave peak voltage V1 and a half-wave peak voltage V2 (refer to dotted lines D and H shown in FIG. 6).

Incidentally, it is also applicable that the configurations of the peak voltage detecting section 93*d* and the peak voltage detecting section 93*e* are the same as each other, and each of them includes, for instance, a low pass filter constituted by a capacitor C and a resister R so that the capacitor C can hold the peak voltage, or otherwise, so that the capacitor C can sample and hold the half-wave peak voltage.

The level determining section 93*f* finds a differential voltage Δv between the half-wave peak voltage V1 and the half-wave peak voltage V2. When the differential voltage is in a predetermined range of, for instance, ±5% of 100V, the level determining section 93*f* determines as a normal state, while, when the differential voltage is out of the predetermined range, the level determining section 93*f* determines as an abnormal state.

Based on both the detected result determined by the phase difference determining section 93*c* and the detected result determined by the level determining section 93*f*, the switch controlling section 93*g* determines the contents of the instruction to be sent to the connection change over section 10. Concretely speaking, when the level determining section 93*f* determines that the differential voltage is in the normal state and the phase difference determining section 93*c* determines that the phase difference T2 is substantially zero, the switch controlling section 93*g* sends the instruction for keeping the phase as it is, while, when the level determining section 93*f* determines that the differential voltage is in the normal state and the phase difference determining section 93*c* determines that the phase difference T2 is substantially 180 degree (½ of the period T1), the switch controlling section 93*g* sends the change over instruction for changing the hot line and the neutral line relative to each other, and then, maintaining the same phase state of them. Further, when the level determining section 93*f* determines that the differential voltage is in the abnormal state, an alarm signal is given to the operator (not shown in the drawings: such as a warning lump, a warning buzzer, etc.). The priority between the determined result of the phase difference determining section 93*c* and that of the level determining section 93*f* is not limited to above.

As described in the foregoing, according to the third embodiment shown in FIG. 5, since the amplitude of the AC voltage is also confirmed in addition to the phase processing of the AC voltage detailed in the second embodiment shown in FIG. 4, it becomes possible to combine the plurality of AC voltages in a manner safer than ever. Namely, FIG. 5 could indicate the whole details of the abovementioned configuration. In this case, the voltage step-down section 91*a* and the diode 91*b*, the voltage step-down section 92*a* and the diode 92*b*, the waveform shaping section 93*a*, the waveform shaping section 93*b*, the phase difference determining section 93*c*, the peak voltage detecting section 93*d*, the peak voltage detecting section 93*e*, the level determining section 93*f* and the switch controlling section 93*g* can be included in the detecting section 9 shown in FIG. 4.

Fourth Embodiment

Referring to FIG. 7, the fourth embodiment will be detailed in the following. In FIG. 7, explanations for the functional elements attached with the same reference numbers as those shown in the FIG. 4 will be omitted, since the functions of both of them are also the same. The detecting section 9 shown in FIG. 7 is included in both the second embodiment and the third embodiment. Further, in the fourth embodiment, as well as in the second embodiment, the phases of the voltages of the AC electric power source 1 and the AC electric power source 2 are possibly different from each other. FIG. 5 shows details of the detecting section 9 shown in FIG. 4. Further, since the configuration and the operation of the detecting section 9 shown in FIG. 7 are independent of those of a current detecting section 11 and a limiter section 12, the explanation of the detecting section 9 is omitted in the following.

The configurations of a current sensor 111 and a current sensor 112 in the current detecting section 11 are the same as each other, and each of them includes a pickup coil for detecting an induction current induced by the electric current flowing into each of the AC cord 3 and the AC cord 4. A load resister is directly coupled to the pickup coil so as to convert the induction current induced in the pickup coil to a terminal voltage between the both ends of the load resister. Further, it is also applicable that the sensor 91 and the sensor 92 equipped in the detecting section 9 are also employed for detecting the electric current flowing into each of the AC cord 3 and the AC cord 4 when the AC voltage is divided, without employing the current sensor 111 and the current sensor 112. In this case, the divided voltage could be employed for this purpose as it is.

A current controlling section 113 detects an amount of current flowing into the AC cord 3 (namely, a supply current to be supplied to the load 8), an amount of current flowing into the AC cord 4 (namely, a supply current to be supplied to the load 8) and a total amount of them, based on the voltage difference between the terminal voltages detected by the current sensor 111 and the current sensor 112. For instance, when the amount of current flowing into the AC cord 3 is about to exceed 15 A, while the amount of current flowing into the AC cord 4 is relatively small, the current controlling section 113 controls a current limiting section 121 so that the amount of current of the AC cord 3 is limited to a value equal to or lower than 15 A, while increase the amount of current of the AC cord 4 by the amount reduced for the AC cord 3. Further, when the total amount of current flowing into both the AC cord 3 and the AC cord 4 is about to exceed 30 A, the current controlling section 113 controls the current limiting section 121 and/or the current limiting section 122 so that the total amount is limited to a value equal to or lower than 30 A. In this case, it is applicable to give an alarm to the operation. Further, it is also applicable that the current controlling section 113 controls the current limiting section 121 and/or the current limiting section 122 so that the amount of current flowing into the AC cord 3 becomes substantially the same as that flowing into the AC cord 4, namely, the balance of them is maintained.

The configurations of the current limiting section 121 and the current limiting section 122 can be the same as each other, and each of them is constituted by power semiconductor elements. For instance, it is possible to control the AC current flowing through a channel between source and drain electrodes by controlling its gate. It is also possible to employ a switching element, called a triac or a thyristor, which performs ON/OFF controlling actions in response to the phase control or the time so as to control the average amount of current.

The order of the current detecting section 11, the limiter section 12, the detecting section 9 and the connection change over section 10 is not limited to that of the embodiment shown in FIG. 7, but freely can be changed. However, when the order of the current detecting section 11 and the limiter section 12 is reversed, compared to that shown in FIG. 7, the current detecting section 11 can conduct the controlling operation by detecting the result actually limited by the limiter section 12. Accordingly, the current controlling section 113 can also conduct the controlling operation so that the current value detected by the current sensor 111 and the current sensor 112 is set at the desired value. Further, when the arranging order of the detecting section 9 and the connection change over section 10 is reversed, compared to that shown in FIG. 7, it becomes possible for the decision controlling section 93 to confirm the change over result of the connection change over section 10. Even if a phase shift occurs in each of the current limiting section 121 and the current limiting section 122, the sensor 91 and the sensor 92 can be disposed at any position, provided that the phase shift in the sensor 91 is approximately the same as that in the sensor 92.

Desirably, it is recommended that the detecting section 9 for detecting the phase and the amplitude of the AC voltage is disposed at a position in the vicinity of the combining section 5 as near as possible. This is because, the detecting section 9 determines the condition for combining the AC voltage of the AC cord 3 with that of AC cord 4.

Incidentally, in the second embodiment, the third embodiment and the forth embodiment, in order to combine the AC cord 3 with the AC cord 4 in a safer way, it is applicable that a power supply switch (not shown in the drawings) is provided just before combining the AC cord 3 with the AC cord 4 in the combining section 5. Concretely speaking, initially, the power supply switch is turned OFF, and the AC cord 3 and the AC cord 4 are coupled to the plug sockets of the AC electric power source 1 and the AC electric power source 2, respectively. Then, after the decision controlling section 93 controls the apparatus so that the phases and the amplitudes of the AC voltages on the AC cord 3 and the AC cord 4 coincide with each other or confirms that those are the same, the power supply switch is turned ON, so as to commence the electric power supplying operation.

The phase difference determining section 93*c*, the level determining section 93*f* and the switch controlling section 93*g* constituting the decision controlling section 93 described in the foregoing can be configured by either the logic electronic circuits or the computer program including the functional steps of them and the CPU for executing the program after converting the inputted signal to the digital data by means of the analogue-to-digital converter.

Modified Example

Incidentally, in the embodiment described in the foregoing, although the image forming apparatus, which employs the fixing section 8*a* including the heating device, is exemplified, the scope of the image forming apparatus is not limited to the above. For instance, the present invention can be also applied to a medium-sized image forming apparatus (or a medium-sized printing apparatus), which is operated in a normal office environment for producing a relatively small amount of print products. In such the case, by implementing the present invention for the image forming apparatus, namely by supplying the necessary electric power to the image forming apparatus form a plurality of wall outlets equipped in the office, it becomes possible to effectively solve the problem for satisfying the electric power capacity of the image forming apparatus in the office. Further, it is also applicable that the abovementioned image forming apparatus is a color or monochrome printing apparatus or a copier, which employs the electro-photographic method (and/or employs the tandem method or the other method).

In the case that a plurality of optional devices, such as paper feeder, etc., serving as a pre-processing apparatus, a stapler, a puncher, a folder, etc., serving as a post-processing apparatus, are coupled to (or included in) the image forming apparatus to form an integrated image forming system (in this invention, such image forming system may be called as an image forming apparatus), it is possible to combine a plurality of AC electric powers fed from a plurality of commercial power sources, which are respectively coupled to the plurality of optional devices, into a single electric power so as to supply the single electric power to the electric power loading sections of the image forming apparatus concerned. It is needless to say that the abovementioned image forming system is also included in the scope of the present invention.

According to the present invention, the following effects can be attained.

(1) Since the plurality of AC power cords coupled to the plurality of AC power supplying sources, which are the same in the phases and the amplitudes of their voltages, can be directly combined with each other or indirectly combined with each other by employing the isolation transformer, etc., it becomes possible to supply the total amount of electric power to be supplied from the plurality of AC power supplying sources to the load coupled to the connecting points.

(2) In the most cases, the plurality of AC power cords are coupled to the plurality of AC power supplying sources through the plug sockets. Accordingly, for instance, depending on the connecting manner between the hot line and the neutral line of the AC power cord, sometimes, the difference between the phases of the voltages of the any two of the plurality of AC power cords could be 180 degree. To cope with this problem, since the phase difference between AC voltages on any two of the plurality of AC power cords is detected so that the phase of any one of the AC voltages is changed over so as to make the phases of the AC voltages substantially equal to each other when the phase difference is detected as substantially 180 degree, it becomes possible to attain the same effect as mentioned in the above.

(3) Since the electric currents flowing through the plurality of AC power cords are detected so that an electric current flowing through a specific one of the plurality of AC power cords is limited to a value equal to or lower than a predetermined current value, when the electric current, flowing through the specific one of the plurality of AC power cords, exceeds the rated current value per one AC power cord, it becomes possible to prevent the apparatus from entering into the overloading state.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus that creates an image on a recording medium, comprising:

a plurality of AC power cords that are respectively coupled to a plurality of AC power supplying sources, which are substantially equivalent to each other in phase and amplitude of AC voltages of the plurality of AC power supplying sources; and a combining section to combine the plurality of AC power supplying sources coupled through the plurality of AC power cords into a single electric power source, so as to make a power supplying capacity of the single electric power source substantially equivalent to a value derived by adding power supplying capacities of the plurality of AC power supplying sources to each other;

wherein combined electric power to be supplied from the single electric power source is distributed to various kinds of sections provided in the image forming apparatus.

2. The image forming apparatus of claim 1, further comprising:

a fixing section having a heater that is activated by AC electric power, serving as a first part of the combined electric power to be supplied from the single electric power source;

a control/processing section that is activated by DC electric power, converted from a second part of the combined electric power to be supplied from the single electric power source;

a heater driving section, coupled between the combining section and the fixing section, to supply the AC electric power having a predetermined current or a predetermined voltage so as to drive the heater of the fixing section; and an AC-DC converting section, coupled between the combining section and the control/processing section, to convert the second part of the combined electric power to the DC electric power to be supplied to the control/processing section.

3. The image forming apparatus of claim 1, wherein the combining section includes:

an isolating transformer having a plurality of primary windings to which the plurality of AC power cords are coupled respectively, so as to make the plurality of AC power supplying sources, coupled through the plurality of AC power cords, serve as the single electric power source, and having a single secondary winding or a plurality of secondary windings from which the combined electric power is distributed to the various kinds of sections provided in the image forming apparatus.

4. The image forming apparatus of claim 1, wherein the combining section includes:

a plurality of circuit breakers to which the plurality of AC power cords are coupled respectively and each of which has a function for detecting an abnormal AC current flowing through a corresponding AC power cord, so as to cut off an input current fed through the corresponding AC power cord when the abnormal AC current is detected; and wherein output ports of the plurality of circuit breakers are directly coupled to each other so as to supply the combined electric power to the various kinds of sections provided in the image forming apparatus from connected points of the output ports.

5. An image forming apparatus, comprising:

a plurality of AC power cords that are respectively coupled to a plurality of AC power supplying sources;

a phase difference detecting section to detect a phase difference between AC voltages on any two of the plurality of AC power cords;

a phase converting section to change over a phase of any one of the AC voltages so as to make phases of the AC voltages substantially equal to each other, based on the phase difference detected by the phase difference detecting section;

a combining section to combine AC electric power units, which are supplied through the plurality of AC power cords and phases of which are made to be substantially equal to each other by employing the phase difference detecting section and the phase converting section, into a combined electric power, so as to supply the combined electric power to a load; and an amplitude difference detecting section to detect an amplitude difference between the AC voltages;

wherein the phase converting section changes over the phase of any one of the AC voltages so as to make the phases of the AC voltages substantially equal to each other, when the amplitude difference detected by the amplitude difference detecting section is substantially equal to zero and the phase difference detected by the phase difference detecting section is substantially equal to 180 degree.

6. The image forming apparatus of claim 5, further comprising:

a fixing section having a heater that is activated by AC electric power and included in the load;

a control/processing section that is activated by DC electric power and included in the load;

a heater driving section, coupled between the combining section and the fixing section, to supply the AC electric power having a predetermined current or a predetermined voltage so as to drive the heater of the fixing section; and an AC-DC converting section, coupled between the combining section and the control/processing section, to convert the combined electric power to the DC electric power to be supplied to the control/processing section.

7. The image forming apparatus of claim 5, wherein the combining section includes:

an isolating transformer having a plurality of primary windings to which the plurality of AC power cords are coupled respectively, so as to supply the AC electric power units into the plurality of primary windings respectively, and having a single secondary winding or a plurality of secondary windings from each of which the combined electric power is supplied to the load.

8. The image forming apparatus of claim 5, wherein the combining section includes:

a plurality of circuit breakers to which the plurality of AC power cords are coupled respectively and each of which has a function for detecting an abnormal AC current flowing through a corresponding AC power cord, so as to cut off an input current fed through the corresponding AC power cord when the abnormal AC current is detected; and wherein output ports of the plurality of circuit breakers are directly coupled to each other so as to supply the combined electric power to the load from connected points of the output ports.

9. An image forming apparatus, comprising:

a plurality of AC power cords that are respectively coupled to a plurality of AC power supplying sources;

a phase difference detecting section to detect a phase difference between AC voltages on any two of the plurality of AC power cords;

a plurality of current detecting sections to detect electric currents flowing through the plurality of AC power cords, respectively;

a phase converting section to change over a phase of any one of the AC voltages so as to make phases of the AC voltages substantially equal to each other, based on the phase difference detected by the phase difference detecting section;

a combining section to combine AC electric power units, which are supplied through the plurality of AC power cords and phases of which are made to be substantially equal to each other by employing the phase difference detecting section and the phase converting section, into a combined electric power;

a current limiting section to limit an electric current flowing through a specific one of the plurality of AC power cords to a value equal to or lower than a predetermined current value, when the electric current, flowing through the specific one of the plurality of AC power cords and detected by any one of the plurality of current detecting sections, exceeds the predetermined current value; and an amplitude difference detecting section to detect an amplitude difference between the AC voltages;

wherein the combined electric power is supplied to a load through the combining section; and wherein the phase converting section changes over the phase of any one of the AC voltages so as to make the phases of the AC voltages substantially equal to each other, when the amplitude difference detected by the amplitude difference detecting section is substantially equal to zero and the phase difference detected by the phase difference detecting section is substantially equal to 180 degree.

10. The image forming apparatus of claim 9, further comprising:

a fixing section having a heater that is activated by AC electric power and included in the load;

a control/processing section that is activated by DC electric power and included in the load;

a heater driving section, coupled between the combining section and the fixing section, to supply the AC electric power having a predetermined current or a predetermined voltage so as to drive the heater of the fixing section; and an AC-DC converting section, coupled between the combining section and the control/processing section, to convert the combined electric power to the DC electric power to be supplied to the control/processing section.

11. The image forming apparatus of claim 9, wherein the combining section includes:

an isolating transformer having a plurality of primary windings to which the plurality of AC power cords are coupled respectively, so as to supply the AC electric power units into the plurality of primary windings respectively, and having a single secondary winding or a plurality of secondary windings from each of which the combined electric power is supplied to the load.

12. The image forming apparatus of claim 9, wherein the combining section includes:

a plurality of circuit breakers to which the plurality of AC power cords are coupled respectively and each of which has a function for detecting an abnormal AC current flowing through a corresponding AC power cord, so as to cut off an input current fed through the corresponding AC power cord when the abnormal AC current is detected; and wherein output ports of the plurality of circuit breakers are directly coupled to each other so as to supply the combined electric power to the load from connected points of the output ports.

* * * * *